US010267465B2

(12) United States Patent
Maxik et al.

(10) Patent No.: US 10,267,465 B2
(45) Date of Patent: Apr. 23, 2019

(54) DOWNLIGHT APPARATUS AND ASSOCIATED METHODS OF ASSEMBLY

(71) Applicant: Lighting Science Group Corporation, Cocoa Beach, FL (US)

(72) Inventors: Fredric S. Maxik, Cocoa Beach, FL (US); Mark Penley Boomgaarden, Cary, NC (US); Ran Zhou, Rockledge, FL (US); Addy Widjaja, Palm Bay, FL (US); Matthew Regan, Melbourne, FL (US); David E. Bartine, Cocoa, FL (US)

(73) Assignee: Lighting Science Group Corporation, West Warwick, RI (US)

( * ) Notice: Subject to any disclaimer, the term of this patent is extended or adjusted under 35 U.S.C. 154(b) by 0 days.

(21) Appl. No.: 15/719,644

(22) Filed: Sep. 29, 2017

(65) Prior Publication Data

US 2018/0023773 A1 Jan. 25, 2018

Related U.S. Application Data

(63) Continuation-in-part of application No. 15/407,348, filed on Jan. 17, 2017.
(Continued)

(51) Int. Cl.
*F21S 8/02* (2006.01)
*F21V 23/02* (2006.01)
(Continued)

(52) U.S. Cl.
CPC ..... *F21S 8/026* (2013.01); *F21K 9/235* (2016.08); *F21K 9/237* (2016.08); *F21K 9/238* (2016.08); *F21V 23/023* (2013.01); *F21V 23/06* (2013.01); *F21V 29/70* (2015.01); *F21V 29/74* (2015.01); *F21V 5/04* (2013.01); *F21V 7/06* (2013.01); *F21Y 2101/00* (2013.01)

(58) Field of Classification Search
CPC .... F21V 7/18; F21V 7/06; F21S 8/026; F21K 9/233; F21K 9/235; F21K 9/237
See application file for complete search history.

(56) References Cited

U.S. PATENT DOCUMENTS 9,829,186 B2 * 11/2017 Becht ..... F21V 23/06
2010/0176730 A1 * 7/2010 Lee ..... F21S 8/026 315/113

(Continued)

OTHER PUBLICATIONS

U.S. Appl. No. 15/407,348, filed Jan. 17, 2017.

*Primary Examiner* — Robert May
*Assistant Examiner* — Leah S Macchiarolo
(74) *Attorney, Agent, or Firm* — Mark Malek; Widerman Malek, PL

(57) ABSTRACT

A downlight apparatus may include a canister with a canister body and a canister base comprising a female helical thread defined as an engagement host. The downlight apparatus may also include a lamp including a lamp body and a male helical ridge, defined as a lamp ridge. The lamp ridge includes a platform that extends distally from a root of the lamp ridge to a distance ranging from 2 to 20 times greater than the distance between the root and the crest of an Edison screw base thread. The lamp and the canister are structured to secure to one another when the lamp engages with the engagement host.

20 Claims, 3 Drawing Sheets

Related U.S. Application Data

(60) Provisional application No. 62/327,859, filed on Apr. 26, 2016.

(51) Int. Cl.

| | |
|---|---|
| ***F21V 23/06*** | (2006.01) |
| ***F21K 9/238*** | (2016.01) |
| ***F21V 29/74*** | (2015.01) |
| ***F21K 9/237*** | (2016.01) |
| ***F21K 9/235*** | (2016.01) |
| ***F21V 29/70*** | (2015.01) |
| *F21V 7/06* | (2006.01) |
| *F21Y 101/00* | (2016.01) |
| *F21V 5/04* | (2006.01) |

(56) References Cited

U.S. PATENT DOCUMENTS

2015/0204532 A1* 7/2015 Lim ..... F21K 9/233
362/373
2015/0241037 A1* 8/2015 Zhang ..... F21V 13/04
362/308

* cited by examiner

DOWNLIGHT APPARATUS AND ASSOCIATED METHODS OF ASSEMBLY

RELATED APPLICATIONS

This application is a continuation-in-part and claims priority under 37 CFR 1.119 to U.S. patent application Ser. No. 15/407,348 titled Lamp Assembly with Universal Base filed Jan. 17, 2017, which is related to and claims priority to U.S. Provisional Patent Application Ser. No. 62/327,859, titled Collapsible Luminaire filed Apr. 26, 2016. The contents of each is incorporated herein in its entirety by reference, except to the extent disclosure therein is inconsistent with disclosure herein.

FIELD OF THE INVENTION

The present invention relates to a downlight apparatus and kit with associated assembly methods.

BACKGROUND

Packaging efficiency remains a problem in the lighting industry since the size and shape of luminaires often involves bulbous components combined with elongated components. Therefore, the structure of traditional lighting inherently lends itself to wasted space when packaged. The structure of the present invention provides a markedly improved space efficiency over the traditionally structured and packaged luminaire. The detachability of the canister allows multiple units to be efficiently packaged in a manner that stacks them vertically. As a result, more surface area of a plurality of detached lighting devices are able to occupy a smaller packaging space than non-detachable lighting. Furthermore, traditionally commercialized canisters sold separately from lamps often require tedious installation. A need exists in the art for an efficiently packaged and easily installable downlight apparatus.

Another disadvantage of traditional lighting is the lack of adaptability with consumer trends. In order for a consumer to change the look of their lighting system, traditional lighting requires that the entire lighting device be replaced. Since most consumers have multiple lighting device systems, this requires replacing multiple lighting devices. The present invention allows a consumer to replace either the lamp unit or the canister unit in order to keep pace with design trends in lighting. This means that the consumer will only pay for a portion of the lighting device instead of the entire device.

Yet another disadvantage of traditional lighting units is the inability for manufacturers to warrant individual components. Under traditional methods, if a lighting device is defective, a manufacturer must replace the entire device under most warranties since the devices are integrated. With the detached componentry of the present invention, a manufacturer may separately warrant the canister unit and the lamp unit. This serves as an advantage to both the consumer and the manufacturer. Instead of a manufacturer having to replace an entire defective lighting device, the manufacturer may only need to replace a smaller, less expensive component. This savings can therefore be passed on to the consumer since the consumer will only be paying for the less expensive replacement component.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a downlight apparatus and kit with associated assembly methods.

One embodiment of the invention may be a downlight apparatus that may include a canister with a canister body and a canister base comprising a female helical thread defined as an engagement host. The downlight apparatus may also include a lamp with a lamp body and a male helical ridge, defined as a lamp ridge. The lamp ridge may include a platform that extends distally from a root of the lamp ridge to a distance ranging from 2 to 20 times greater than the distance between the root and the crest of an Edison screw base thread. The lamp and the canister may be structured to secure to one another when the lamp engages with the engagement host.

In some embodiments, the downlight apparatus may include a lamp with a screw base with the screw base at one end and an optical chamber at another end. The screw base may be an Edison base extending distally from the lamp body.

In some embodiments, the engagement host and the lamp ridge may be structured to extend more than 360 degrees around their respective lamp body and canister base. Furthermore, the downlight apparatus may be structured to where the lamp ridge may threadably engage into the engagement host and the screw base may be structured to threadably engage into a socket.

In some embodiments, the lead of the engagement host may be larger than a lead of the E26 thread. Additionally, in some embodiments the measurement between internal threads of the engagement host may correspond to the lead of the lamp ridge. In some embodiments, the lamp ridge may be threaded in an opposite direction than the screw base.

In some embodiments, the canister base may have a depth within a range from 0.5 inches to 1.5 inches and may extend distally from the canister body. Furthermore, the canister may include a canister trim that is positionable so as to be flush against an external structure. Additionally, the canister trim may define a diameter greater than an outer dimension of the canister base and the canister body may be tapered from the canister trim to the canister base defining a concave shape.

In some embodiments, the canister body may have a thickness within a range from 0.0625 inches to 0.125 inches. Furthermore, the canister may be formed of thermally conductive material selected from the group consisting of silver, copper, gold, aluminum, steel, metal alloys, and plastic.

In some embodiments, the downlight apparatus assembly may include a canister with a canister body and a canister base including a female helical thread defined as an engagement host and a lamp including a lamp base and a lamp body. The lamp body may include a male helical ridge defined as a lamp ridge. The lamp ridge may have a platform that extends distally from a root of the lamp ridge to a distance ranging from 2 to 20 times greater than the distance between the root and the crest of an Edison base thread. In this embodiment, the lamp and the canister may be structured to secure to one another when the lamp ridge is threadably engaged into the engagement host. Furthermore, in this embodiment the lamp ridge may include a 360-degree distance around the lamp body circumference that may enable the lamp to complete one rotation.

In this embodiment, the lamp base may be structured to engage with a socket of an external structure and the lamp ridge may be structured to contemporaneously secure into the canister body. Furthermore, the canister may be formed of thermally conductive material structured to draw heat away from the lamp. In this embodiment and the lamp may be structured to be thermally coupled to the canister when the lamp is threadably engaged into a socket. Additionally, the canister may include a canister trim that is positionable so as to flush fit against an external structure.

In some embodiments, the apparatus may be included in a luminaire downlight kit with a canister including a canister body and a canister base. The canister base may include a helical thread defined as an engagement host. Furthermore, the kit may include a lamp with a lamp body including a helical ridge defined as a lamp ridge structured to matingly engage the engagement host. The kit may also include a box configured to carry one of the canister body and the lamp or a plurality of canister bodies and lamps that are detached from one another. In this embodiment, the lamp and the canister may be structured to secure to one another when the lamp ridge is threadably engaged into the engagement host. Furthermore, in this embodiment, the lamp ridge may be structured to extend more than a 360-degree distance around the lamp body circumference enabling the lamp to complete more than one rotation.

Furthermore, some embodiments may include the canister with a canister trim formed to secure to an external structure with a flush fit. Additionally, a convex surface of the canister body, defined as the outside surface, may include heat sink fins extending longitudinally from the canister base to a nominal distance from the canister trim.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides a downlight apparatus and kit with associated assembly methods.

Figure 1:
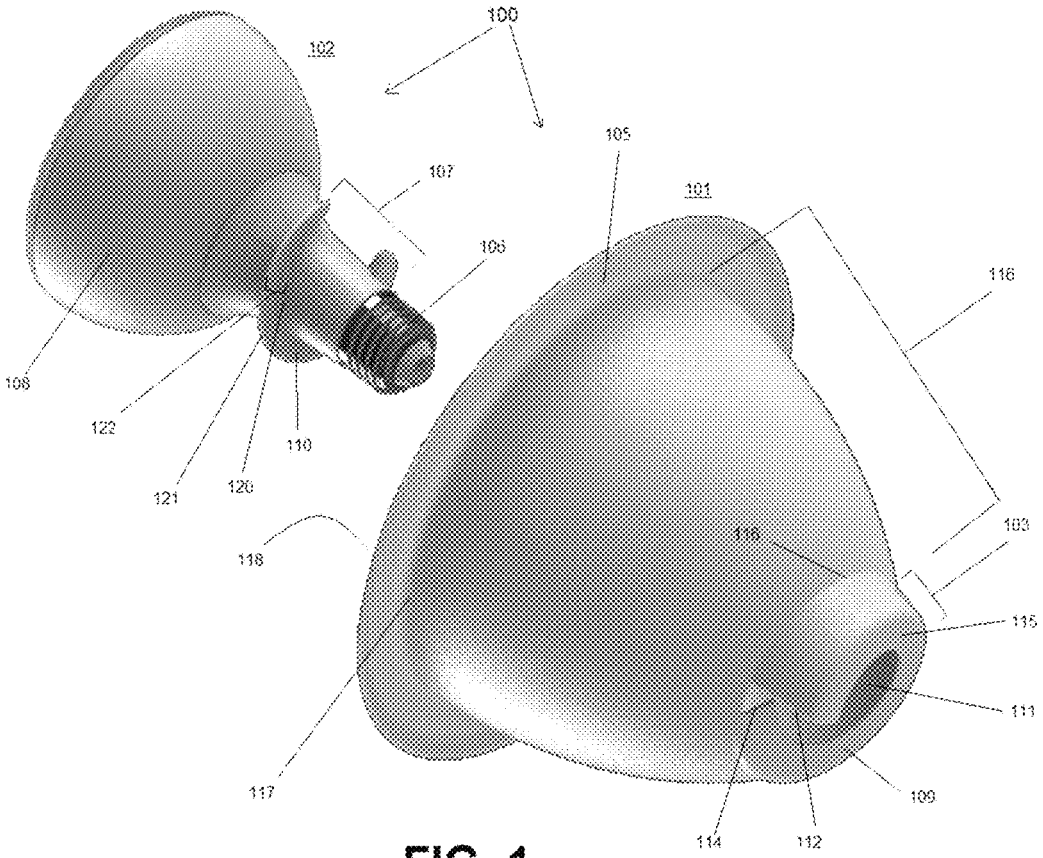
FIG. 1 is a perspective view of a downlight apparatus according to an embodiment of the present invention and showing a detached canister and lamp assembly.

Referring to FIG. 1, the downlight apparatus and kit 100 (hereinafter "the apparatus 100") may include a canister 101 and a lamp 102. The lamp 102 may include a screw base 106, a lamp body 107, and an optical chamber 108. The canister 101 may include a canister base 103, a canister body 104, and a canister trim 105.

The canister base 103 may be positioned between a canister rear surface 115 and a canister body proximal end 116. The canister base 103 may form a female helical thread, defined as an engagement host 109. The engagement host 109 may include the canister rear surface 115, which may be structured as a flat, yet angled and spiraled bottom surface of the canister 101. The spiral may allow for the engagement host 109 to engage a male helical ridge, defined as a lamp ridge 110, located on the lamp body 107. The engagement host 109 and the lamp ridge 110 together may be operable to convert linear movement to rotational movement and vice versa. Therefore, the lamp ridge 110 and the engagement host 109 may coordinate to secure the lamp 102 to the canister 101 to form the apparatus 100.

The engagement host 109 may encircle a base aperture 111 within the canister 101. The diameter of the base aperture 111 may be dimensioned to accommodate an Edison base lamp size E12 or E14 therethrough. However, it is contemplated to be within the scope herein that the diameter of the base aperture 111 of the canister base 103 may be dimensioned to accommodate any lamp size including an E11, E17, E26 and E27 therethrough. Furthermore, the canister base 103 and consequently the base aperture 111 may be dimensioned to accommodate a lamp 102 of any size including a Parabolic Aluminized Reflector (PAR), a Bulged Reflector (BR), or a standard Reflector (R).

The depth of the canister base 103 may be larger at an engagement host first end 112 and may be smaller at an engagement host second end 114. Hence, the engagement host 109 may be structured as an internal tapered thread, or helix, between its host first end 112 and host second end 114. In one embodiment, the depth of the canister base 103 may be 1 to 1.5 inches at the host first end 112 and 1 mm at the host second end 114. However, it is contemplated to be within the scope herein that the depths of the host first end 112 and the host second end 114 may be greater or less depending on consumer demand and the type and size of the lamp 102. In this embodiment, the depth of the canister base 103 may gradually decrease between the host first end 112 and host second end 114 as the engagement host 109 spirals between the two respectively. Furthermore, the engagement host 109 may wrap around the canister base 103 in a helical fashion to a total length of 360 degrees around. In other embodiments, the engagement host 109 may not extend to 360 degrees around and in still other embodiments the engagement host 109 may extend to greater than 360 degrees around. In any embodiment, the engagement host 109 may extend to a length and degree consistent with the length and degree of the lamp ridge 110.

The canister body 104 may be the medial portion of the canister 101 positioned between the canister base 103 and the canister trim 105. The canister body 104 may be a hollow bowl-shaped frustum with a convex exterior surface and a concave interior surface so that the canister body 104 may taper between the canister trim 105 and the canister base 103. The diameter of the canister body 104 may be smaller proximate the canister base 103 and may be larger at a canister body distal end 117 proximate the canister trim 105. In some embodiments, the canister body 104 may be a thickness of between 0.0625 and 0.125 inches. The canister body distal end 117 may circumscribe a large aperture defined as the canister opening 118. In some embodiments, the canister body 104 and/or the entire canister 101 or portions thereof may be formed from one or a combination of materials including silver, copper, gold, aluminum, steel and plastic. In any embodiment, the canister 101 may be formed of thermally conductive material enabled to draw heat away from the lamp 102 when the canister 101 and lamp 102 are secured to each other as well as when the lamp 102 is threadably engaged in a socket. Furthermore, the convex exterior surface of the canister body 104 may include heat sink fins extending longitudinally from the canister base 103 to a nominal distance from the canister trim 105.

The canister trim 105 may circumscribe the canister body distal end 117 and the canister opening 118. The canister trim 105 may be a trim plate that extends outwardly from the canister body 104 and may include a diameter greater than the canister base 103. The canister trim 105 may be formed so that one surface may fit flush against an external structure such as a ceiling or a wall. However, it is contemplated herein that the canister trim 105 may include any number of shapes that may allow it to abut an external structure but not necessarily fit flush. Such shapes may include a disk, a ring, or a generally arcuate formation that may allow only a portion of the canister trim 105 to abut an external structure such as the edges of the canister trim 105.

Referring now to the lamp 102 in FIG. 1, it may be structured to fit within the canister 101 so that the lamp 102 and canister 101 may be operable as a monolithic unit when secured to each other. More specifically, the lamp 102 may be structured so that the screw base 106 encompasses a first end, which in some embodiments may be an Edison base. The lamp body 107 may be an elongate medial portion of the lamp 102 positioned between the screw base 106 and the optical chamber 108. In some embodiments, the lamp body 107 may be cylindrical in shape with curved sides as its core. However, any shape including rectangular prism or polygonal prism shaped is contemplated herein.

The optical chamber 108 may extend distally from the lamp body 107 and may be a bowl-shaped member with a concave exterior surface and a convex interior surface. However, any shape including pyramidal, cubic, oval, cylindrical, spherical, and polygonal may form the optical chamber 108. A lens (not shown) may encompass one end of the optical chamber 108 and may include the second end of the lamp 102. Also within the optical chamber 108 may be a light source (not shown) enclosed by the walls of the optical chamber 108.

Located on the lamp body 107 may be the lamp ridge 110. The lamp ridge 110 may be a male external tapered thread, or helix, extending outwardly from the lamp body 107 and wrapping around it. In some embodiments, the lamp ridge 110 may wrap around the lamp body 107 in a helical fashion to a total length of 360 degrees around. In other embodiments, the lamp ridge 110 may not extend to 360 degrees around the lamp body 107 and in still other embodiments the lamp ridge 110 may extend to greater than 360 degrees around the lamp body 107. In any embodiment, the lamp ridge 110 may encircle the lamp body 107 to a length and degree consistent with the length and degree of the engagement host 109 of the canister 101. Furthermore, in some embodiments the angle of the lamp ridge 110 may directly correspond to the angle of the screw base 106, which in some embodiments may be an Edison base. The lamp ridge 110 may be structured to threadably engage the engagement host 109 and the screw base 106 may be structured to threadably engage a socket. In some embodiments, the lamp ridge 110 and screw base 106 may secure into their respective hosts contemporaneously and in some embodiments the lamp ridge 110 may secure into the engagement host 109 before the screw base 106 engages a socket. In the latter embodiment, the apparatus 100 is tightened as a monolithic unit before securing to the socket.

The length to which the lamp ridge 110 extends outwardly from the lamp 102 may be measured from a root 120 of the lamp 102 to a crest 121 of the lamp ridge 110, defined as a flank 122. In some embodiments, the flank 122 may range from 0.25 inches to 2 inches. However, this distance may be larger or smaller depending on the type and size of the lamp 102. In some embodiments, the flank 122 may be dimensioned relative to the screw base 106. For instance, in some embodiments the flank 122 may be 2 to 20 times greater than a flank of an Edison base thread, for example an E11, E17, E26 or E27.

In some embodiments where the lamp ridge 110 wraps around the lamp body 107 to a length and degree greater than 360 degrees, the distance between two crests 121 may be defined as a lead. In some embodiments, the lead may measure 0.25 to 2 inches and in other embodiments it may be dimensioned relative to the screw base. For instance, in some embodiments the lead may be 2 to 20 times greater than a lead of an Edison base thread, for example an E11, E17, E26 or E27.

In embodiments where the lamp ridge 110 measures greater than 360 degrees around, the dimensions of the engagement host 109 will likewise correspond. Meaning, the distance parallel to an axis of the engagement host 109 from a point on its internal thread to a corresponding point on an adjacent internal thread in the same axial plane and same side of the axis, may correlate to the measurement of the lead of the lamp ridge 110. Therefore, if the lead of a lamp ridge 110 measures 2 to 20 times greater than an Edison base, such as an E11, E17, E26 or E27, the distance between internal threads of the engagement host 109 may be the same.

In some embodiments, the apparatus 100 may be a kit. In these embodiments, the kit may include the canister 101 or plurality of canisters 101, the lamp 102 or a plurality of lamps 102, and a container sized to accommodate them. In some embodiments, the container may be a box, but other containers are contemplated to be within the scope herein.

Figure 2:
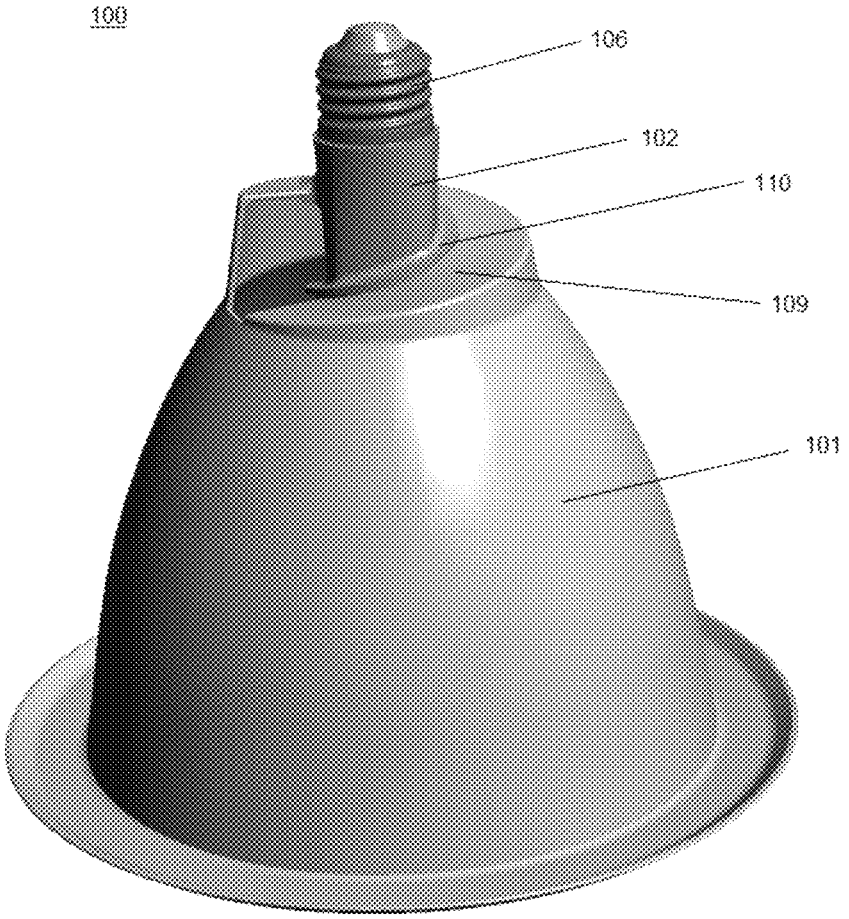
FIG. 2 is a perspective view of the downlight apparatus illustrated in FIG. 1 and showing the canister and lamp assembly in an assembled configuration.
Figure 3:
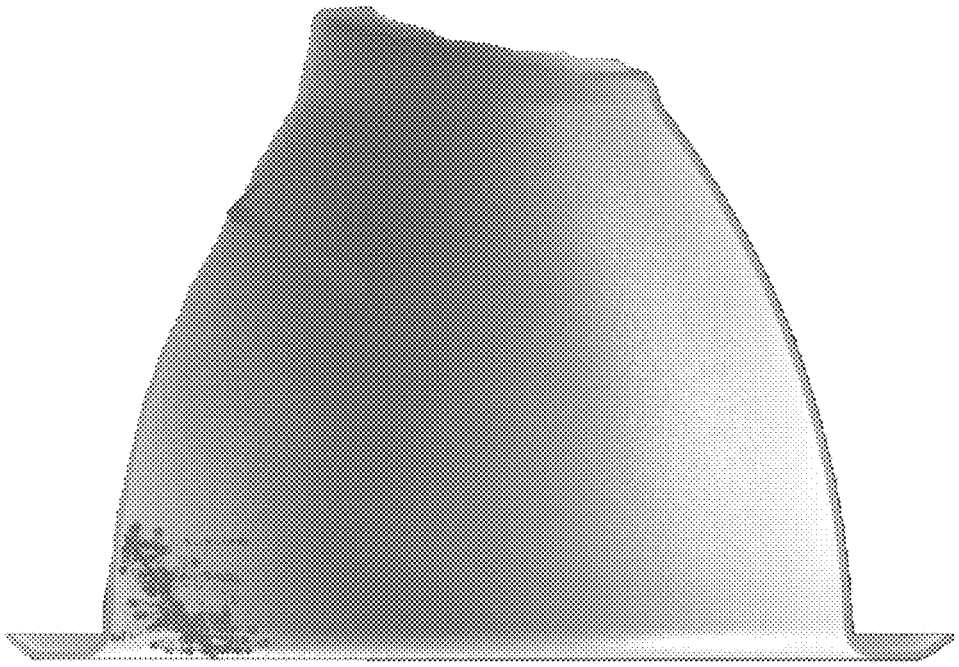
FIG. 3 is a side perspective view of a canister of the downlight apparatus illustrated in FIG. 1.

Referring now additionally to FIG. 2, the apparatus 100 may be assembled as a monolithic unit before installation into a socket. With this method, a user may place the lamp 102 into the canister 101 and fit the lamp ridge 110 onto a portion of the engagement host 109. A user may then rotate the lamp 102 so that the lamp ridge 110 threadably engages the engagement host 109. When the lamp ridge 110 and the engagement host 109 are threadably engaged and tightened, a portion of the lamp body 107 may protrude through the base aperture 111 leaving the screw base 106 exposed. In some embodiments, the lamp ridge 110 may be structured to rotate in a consistent direction with the screw base 106 so that when the apparatus 100 is assembled the apparatus 100 may easily be screwed into a socket without loosening or detaching the lamp 102 from the canister 101. Hence, in some embodiments, the lamp ridge 110 and screw base 106 may be tightened contemporaneously. However, in some embodiments the lamp ridge 110 may be structured to rotate in an opposite direction with the screw base 106.

In an embodiment where both the lamp ridge 110 and the screw base 106 are oriented to rotate in the same direction, a user may place the canister 101 over a socket on a wall, ceiling, or the like, and may hold it in position while threadably engaging the lamp 102 with the canister 101 and the screw base 106 with the socket.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus, the scope of the invention should be determined by the appended claims and their legal equivalents, and not by the examples given.

That which is claimed is:

1. A downlight apparatus comprising:
a canister comprising
a canister body, and
a canister base comprising a female helical thread defined as an engagement host; and
a lamp comprising
a lamp body, and
a male helical ridge, defined as a lamp ridge, comprising a platform that extends distally from a root of the lamp ridge to a distance ranging from 2 to 20 times greater than the distance between the root and a crest of an Edison screw base thread;
wherein the lamp and the canister are configured to secure to one another when the lamp engages with the engagement host.

2. The downlight apparatus of claim 1 wherein the lamp comprises a screw base; and wherein the lamp body is connected to the screw base at one end and an optical chamber at another end.

3. The downlight apparatus of claim 2 wherein the screw base is an Edison base extending distally from the lamp body.

4. The downlight apparatus of claim 2 wherein the engagement host and the lamp ridge are configured to extend more than 360 degrees around their respective lamp body and canister base.

5. The downlight apparatus of claim 2 wherein the lamp ridge is configured to threadably engage into the engagement host and the screw base is configured to threadably engage into a socket.

6. The downlight apparatus of claim 2 wherein a lead of the engagement host is larger than a lead of the Edison screw base thread.

7. The downlight apparatus of claim 6 wherein a distance between internal threads of the engagement host correspond to the lead of the lamp ridge.

8. The downlight apparatus of claim 2 wherein the lamp ridge is threaded in an opposite direction than the screw base.

9. The downlight apparatus of claim 1 wherein the canister base has a depth within a range from 0.5 inches to 1.5 inches and extends distally from the canister body.

10. The downlight apparatus of claim 1 wherein the canister comprises a canister trim that is positionable so as to be flush against an external structure.

11. The downlight apparatus of claim 10 wherein the canister trim defines a diameter greater than an outer dimension of the canister base and the canister body is tapered from the canister trim to the canister base defining a concave shape.

12. The downlight apparatus of claim 11 wherein the canister body has a thickness within a range from 0.0625 inches to 0.125 inches.

13. The downlight apparatus of claim 1 wherein the canister is formed of thermally conductive material selected from the group consisting of silver, copper, gold, aluminum, steel and plastic.

14. A downlight apparatus assembly comprising:
a canister comprising
a canister body; and
a canister base comprising a female helical thread defined as an engagement host; and
a lamp comprising
a lamp base; and
a lamp body comprising a male helical ridge defined as a lamp ridge, comprising a platform that extends distally from a root of the lamp ridge to a distance ranging from 2 to 20 times greater than the distance between the root and a crest of an Edison screw base thread;

wherein the lamp and the canister are configured to secure to one another when the lamp ridge is threadably engaged into the engagement host; and wherein the lamp ridge extends 360-degrees around the lamp body circumference and is configured to enable the lamp to complete one rotation.

15. The downlight apparatus assembly according to claim 14 wherein the lamp base is configured to engage with a socket of an external structure and the lamp ridge is configured to contemporaneously secure into the canister body.

16. The downlight apparatus assembly according to claim 14 wherein the canister is formed of thermally conductive material configured to draw heat away from the lamp; and wherein the lamp is configured to be thermally coupled to the canister when the lamp is threadably engaged into a socket.

17. The downlight apparatus assembly according to claim 14 wherein the canister comprises a canister trim that is positionable so as to flush fit against an external structure.

18. A luminaire downlight kit comprising:

a canister comprising;

a canister body; and a canister base comprising a helical thread defined as an engagement host;

a lamp comprising;

a lamp body comprising a helical ridge defined as a lamp ridge configured to matingly engage the engagement host; and a box configured to carry one of the canister body and the lamp or a plurality of canister bodies and lamps that are detached from one another;

wherein the lamp and the canister are configured to secure to one another when the lamp ridge is threadably engaged into the engagement host; and wherein the lamp ridge extends more than a 360-degrees around the lamp body circumference and is configured to enable the lamp to complete more than one rotation.

19. The luminaire downlight kit of claim 18 wherein the canister further comprises a canister trim configured to secure to an external structure with a flush fit.

20. The luminaire downlight kit of claim 19 wherein a convex surface of the canister body, defined as the outside surface, comprises heat sink fins extending longitudinally from the canister base to a nominal distance from the canister trim.

* * * * *